US009228332B2

(12) United States Patent
Schuster et al.

(10) Patent No.: US 9,228,332 B2
(45) Date of Patent: Jan. 5, 2016

(54) OFFSETTING DUAL FLUSH ADAPTER

(75) Inventors: Michael J. Schuster, Joliet, IL (US); Duston E. A. Stutzman, Plainfield, IL (US); Doug Saunders, Plainfield, IL (US)

(73) Assignee: DANCO, INC., Irving, CA (US)

( * ) Notice: Subject to any disclaimer, the term of this patent is extended or adjusted under 35 U.S.C. 154(b) by 623 days.

(21) Appl. No.: 13/096,162

(22) Filed: Apr. 28, 2011

(65) Prior Publication Data

US 2012/0017363 A1 Jan. 26, 2012

Related U.S. Application Data

(60) Provisional application No. 61/328,874, filed on Apr. 28, 2010.

(51) Int. Cl.

| | |
|---|---|
| ***E03D 1/14*** | (2006.01) |
| ***F16M 13/02*** | (2006.01) |
| ***E03D 1/34*** | (2006.01) |

(52) U.S. Cl.

CPC ..... *E03D 1/34* (2013.01)

(58) Field of Classification Search

CPC ..... E03D 1/14; E03D 1/34
USPC ..... 4/324, 325, 326; 248/219.1, 219.2
See application file for complete search history.

(56) References Cited

U.S. PATENT DOCUMENTS

| | | | | | |
|---|---|---|---|---|---|
| 2,282,685 | A | * | 5/1942 | Timbs | 24/135 A |
| 3,744,064 | A | | 7/1973 | Preston | |
| 3,758,893 | A | † | 9/1973 | Smolinski | |
| 3,839,746 | A | | 10/1974 | Kowalski | |
| 3,839,747 | A | † | 10/1974 | Clark | |
| 3,988,785 | A | | 11/1976 | Schoepe et al. | |
| 4,145,774 | A | | 3/1979 | Sullivan | |
| 4,145,775 | A | | 3/1979 | Butler | |
| 4,329,260 | A | | 5/1982 | Lester et al. | |
| 4,391,003 | A | | 7/1983 | Talerico et al. | |
| 4,485,501 | A | | 12/1984 | Kloner | |
| 4,488,388 | A | | 12/1984 | Schmidt | |
| 4,707,867 | A | | 11/1987 | Kawabe et al. | |
| 4,764,996 | A | | 8/1988 | Pino | |
| 4,918,764 | A | | 4/1990 | Haselswerdt et al. | |
| 5,036,553 | A | | 8/1991 | Sanderson | |
| 5,103,507 | A | * | 4/1992 | Sprajc et al. | 4/324 |
| 5,134,729 | A | | 8/1992 | Shaw | |
| 5,211,204 | A | | 5/1993 | Mikol | |
| 5,325,547 | A | † | 7/1994 | Pino | |
| 5,432,959 | A | | 7/1995 | Ellsworth et al. | |
| 5,469,586 | A | | 11/1995 | Tsutsui et al. | |
| 5,680,659 | A | * | 10/1997 | Gessaman | 4/325 |
| 5,742,951 | A | | 4/1998 | Wright et al. | |
| 5,794,279 | A | | 8/1998 | Schwartz | |
| 5,862,537 | A | | 1/1999 | Osmond | |

(Continued)

*Primary Examiner* — Huyen Le
*Assistant Examiner* — Christine Skubinna
(74) *Attorney, Agent, or Firm* — Thomas | Horstemeyer LLP; Michael J. D'Aurelio; Randy R. Schoen

(57) ABSTRACT

Various methods and systems are provided for offsetting of flush adapters. In one embodiment, an apparatus includes an adapter configured to attach to a flush mechanism configured to provide for a predefined flush capability in a toilet, a gasket attached to adapter, the gasket forming a seal between the flush mechanism and a flush orifice of a flush valve, where the flush valve is configured to seat a sealing member, and means for securing the gasket in position with respect to the flush orifice of the flush valve.

17 Claims, 19 Drawing Sheets

(56) References Cited

U.S. PATENT DOCUMENTS

| | | | | |
|---|---|---|---|---|
| 6,202,227 | B1 | 3/2001 | Gurowitz | |
| 6,234,541 | B1 * | 5/2001 | Wagner et al. | 285/197 |
| 6,263,519 | B1 | 7/2001 | Parsons et al. | |
| 6,823,889 | B1 | 11/2004 | Schuster | |
| 6,829,787 | B1 † | 12/2004 | Pipenburg | |
| 6,837,264 | B1 | 1/2005 | Schuster | |
| 7,073,209 | B1 | 7/2006 | McCormick | |
| 7,140,050 | B2 | 11/2006 | Muderlak | |
| 7,526,819 | B2 | 5/2009 | Beaupre | |
| 8,087,105 | B2 * | 1/2012 | Tang | 4/324 |
| 2004/0068784 | A1 | 4/2004 | Muderlak | |
| 2005/0172387 | A1 | 8/2005 | Higgins | |
| 2008/0201833 | A1 † | 8/2008 | Scruggs | |
| 2010/0218308 | A1 | 9/2010 | Schuster et al. | |

* cited by examiner
† cited by third party

FIG. 3B
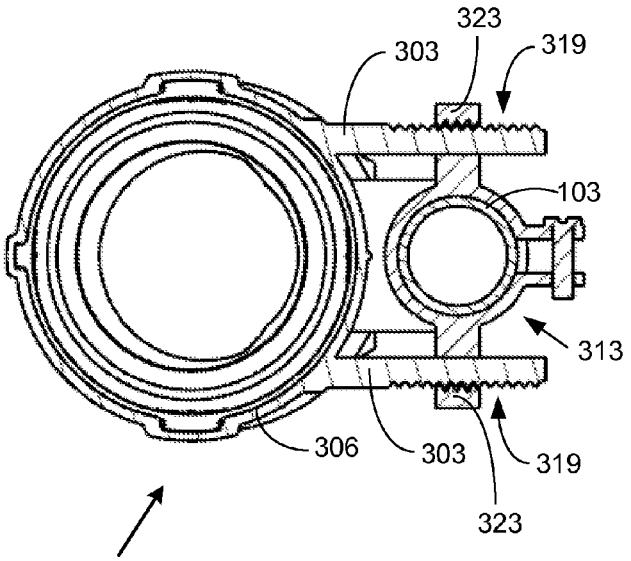
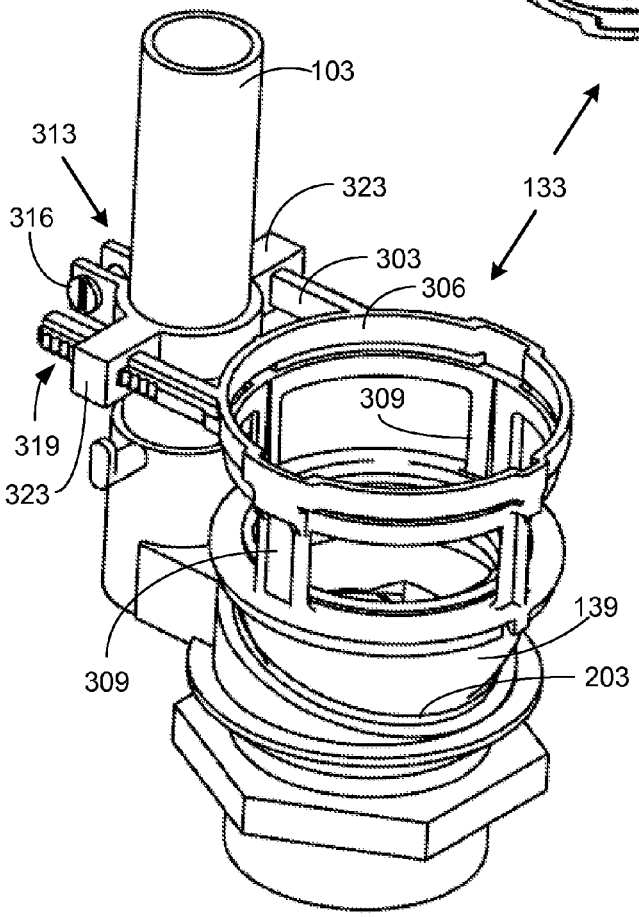
FIG. 3A

OFFSETTING DUAL FLUSH ADAPTER

CROSS REFERENCE TO RELATED APPLICATIONS

This application claims priority to U.S. provisional application entitled "OFFSETTING DUAL FLUSH ADAPTER" having Ser. No. 61/328,874, filed Apr. 28, 2010, the entirety of which is hereby incorporated by reference.

BACKGROUND

Most toilets in the United States feature a single flush capability that typically uses more water than is needed to flush urine and tissue. This translates into a colossal waste of water each year. Also, typical flush valves that include a flapper preclude the use of other flush technologies without significant effort needed to remove a toilet tank, remove an existing flush valve, and install a new style flush valve, or result in limited fit or function.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

FIGS. 3A-3E, 4A-4B, 5A-5B, and 6A-6D are drawings that provide various views of a single flush toilet flush valve with other dual flush adaptors according to various embodiments.

DETAILED DESCRIPTION

Figure 1A:
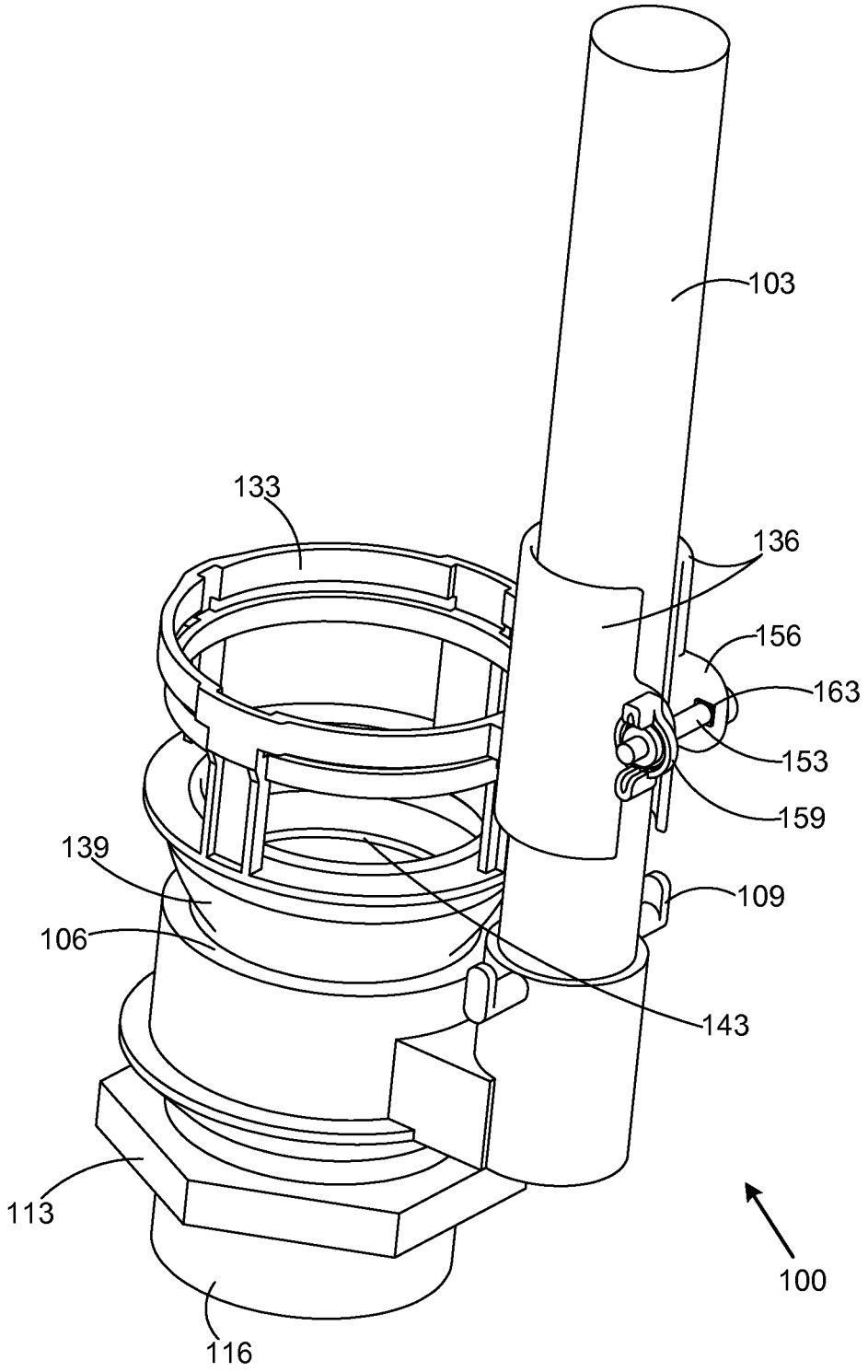
FIGS. 1A-1D are drawings that provide various views of a single flush toilet flush valve with a dual flush adaptor according to various embodiments.
Figure 1B:
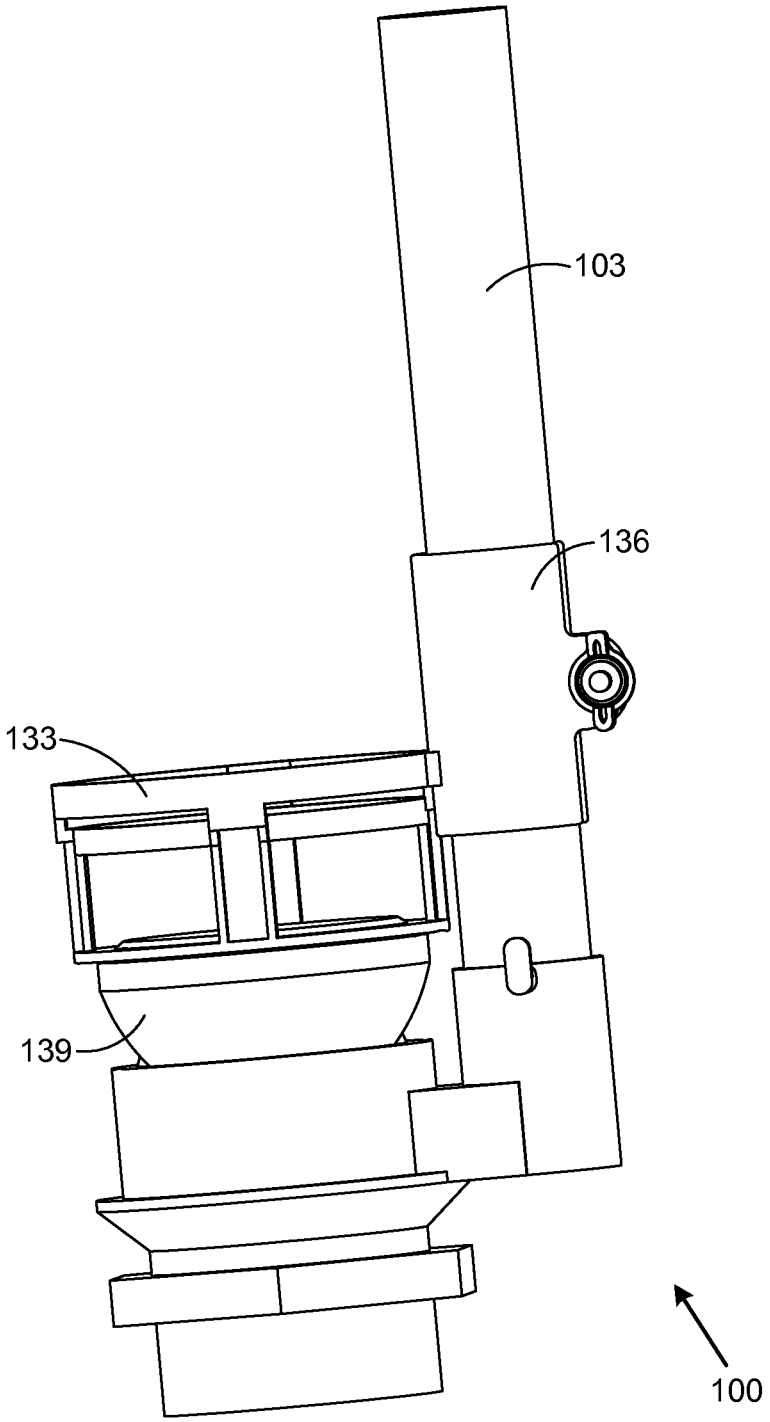

With reference to FIGS. 1A-1D, shown are various views of a toilet flush valve 100 that includes an overflow tube 103. The flush valve 100 is generally employed in gravity toilets and includes an orifice 106 through which water drains into a toilet bowl during a flush of a toilet as can be appreciated. The orifice 106 is typically sealed using a flapper that hinges upon ears 109 that extend from the sides of the overflow tube 103. Some flush valves do not use a flapper or have ears 109 as such as might be the case with a ball-type flush valve, but typically include an overflow tube 103. In any event, the flush valves as described herein are those that are configured to seat a flapper, flush ball, gasket, or other sealing member to ensure that water does not leak into the toilet bowl until a flush is initiated.

A sealing washer such as a rubber washer or other sealing structure is sandwiched between the flush valve 100 and the bottom of the tank as can be appreciated. The flush valve 100 also includes a retaining nut 113 that is used to secure the flush valve 100 to the bottom of a toilet tank and serves to compress the rubber washer or other sealing structure. The flush valve 100 includes a threaded portion 116 upon which the retaining nut 113 is fastened. Also, another gasket may be employed to seal between the toilet tank and the toilet bowl.

Also depicted in FIGS. 1A-1D is an adapter 133. The adapter includes a clamp 136 that can be affixed to the overflow tube 103 as shown. To this end, the adapter 133 can move up and down with the clamp 136 sliding up and down the overflow tube until the clamp 136 is tightened as shown. Attached to the adapter 133 is a gasket 139. The gasket 139 is configured to be compatible with the flush orifice 106 such that it can mate with the junction forming a seal between the gasket 139 and the flush orifice 106. Also, the gasket 139 is attached to the bottom of the adapter 133 in such a manner that a seal is formed at the junction between the adapter 133 and the gasket 139. The adapter 133 may be viewed as a basket that includes a flush orifice 143 that is compatible with various flush mechanisms such as dual flush devices, siphonic flush valves, electronically operated dual flush valves, or other flush mechanisms. Although the following discussion mentions dual flush mechanisms, it is understood that the adapter 133 is not limited for use with such dual flush mechanisms, and that other flush mechanisms may be mated with the adaptor 133 as desired.

The adapter 133 is configured to mate with a flush mechanism such as a dual flush canister so that the dual flush canister can open or close the flush orifice 143 to implement a flush of a toilet. To this end, two different flushes may be implemented. One uses a minimum amount of water to flush urine and tissue down the drain. The second uses an additional amount of water to flush excrement and tissue, etc., down the drain.

To tighten the clamp 136 on the overflow tube 103, a carriage bolt 153 extends through holes of ears 156 associated with the clamp 136. The carriage bolt 153 may include a wing nut or other locking nut 159 that, when tightened, causes the leaves of the clamp 136 to compress the overflow tube 103. The carriage bolt 153 may include a square portion 163 that mates with a square hole in a given one of the ears 156 to prevent the carriage bolt from rotating when the wing nut 159 is tightened. In other embodiments, the clamp 136 may be tightened on the overflow tube 103 using spring clamps, self-tapping screws, rubber ring, or other appropriate fasteners. For example, a zip tie 166 (or cable tie) may be used to tighten clamp 136 on the overflow tube 103.

By virtue of the adapter 133 being mated with the flush orifice 106 by way of the gasket 139, an existing single flush valve 100 that may already be installed in a toilet can be converted to a dual flush mechanism. To this end, the adapter 133 and the gasket 139 facilitate conversion of existing single flush valves 100 to dual flush mechanisms. Specifically, the adapter is slid down over the overflow tube 103 until the gasket 139 engages the flush orifice 106. An individual may then press the adapter 133 downward such that the gasket 139 mates properly with the flush orifice 106 and seals the junction therebetween.

To this end, the gasket 139 may be deformed slightly to provide for a better seal. At this point, the adapter 133 may be held in place until the wing nut 159 is tightened, thereby tightening the clamp 136 onto the overflow tube. In this manner, the adapter 133 is held into place. In addition, when water fills up in a toilet tank, water pressure against the adaptor assembly aids in holding the adapter 133 in the proper position to maintain the seal formed between the flush orifice 106 and the gasket 139. The flush valve 100 as shown in FIGS. 1A-1D is a horizontal style flush valve in that the flush orifice 106 is oriented in a horizontal direction relative to the bottom wall of a toilet tank in which the flush valve 100 is installed.

Figure 1C:
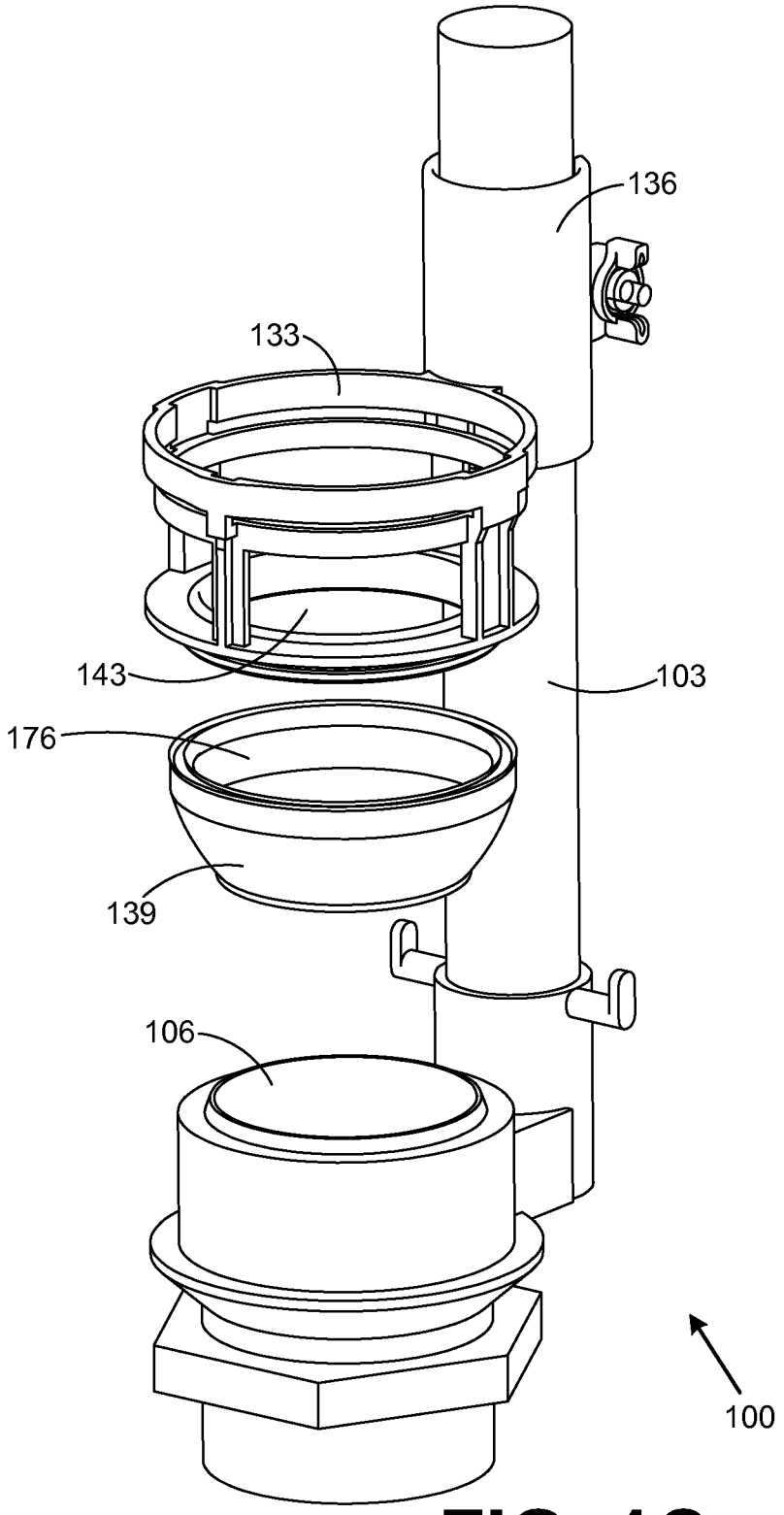
Figure 1D:
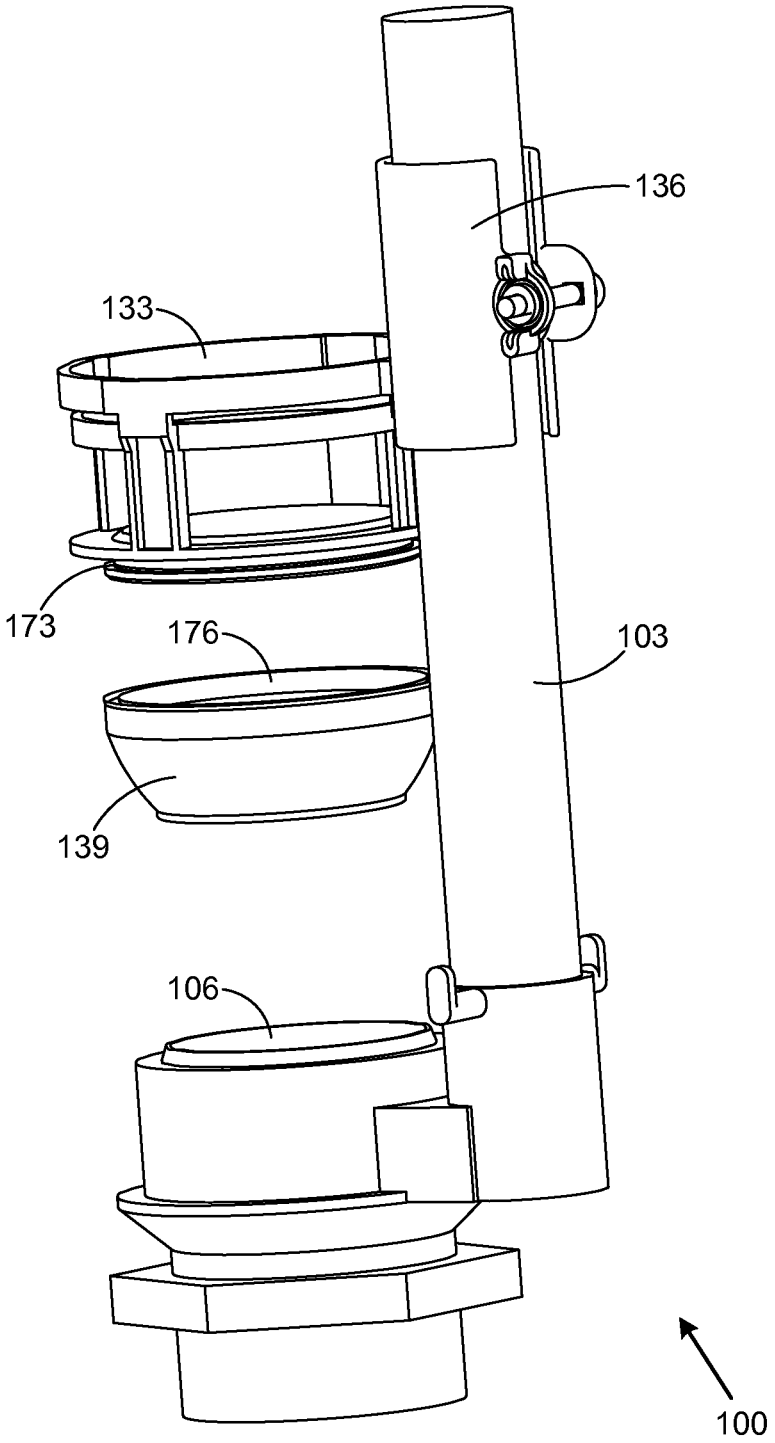

With specific reference to FIGS. 1C and 1D, shown are exploded views of the adapter 133 with the gasket 139 separated. As depicted in FIG. 1D, the adapter 133 includes an annular recess 173 which mates up with an inward annular projection 176 on the gasket 139 to provide for a seal between the adapter 133 and the gasket 139 as will be described in greater detail.

Figure 2A:
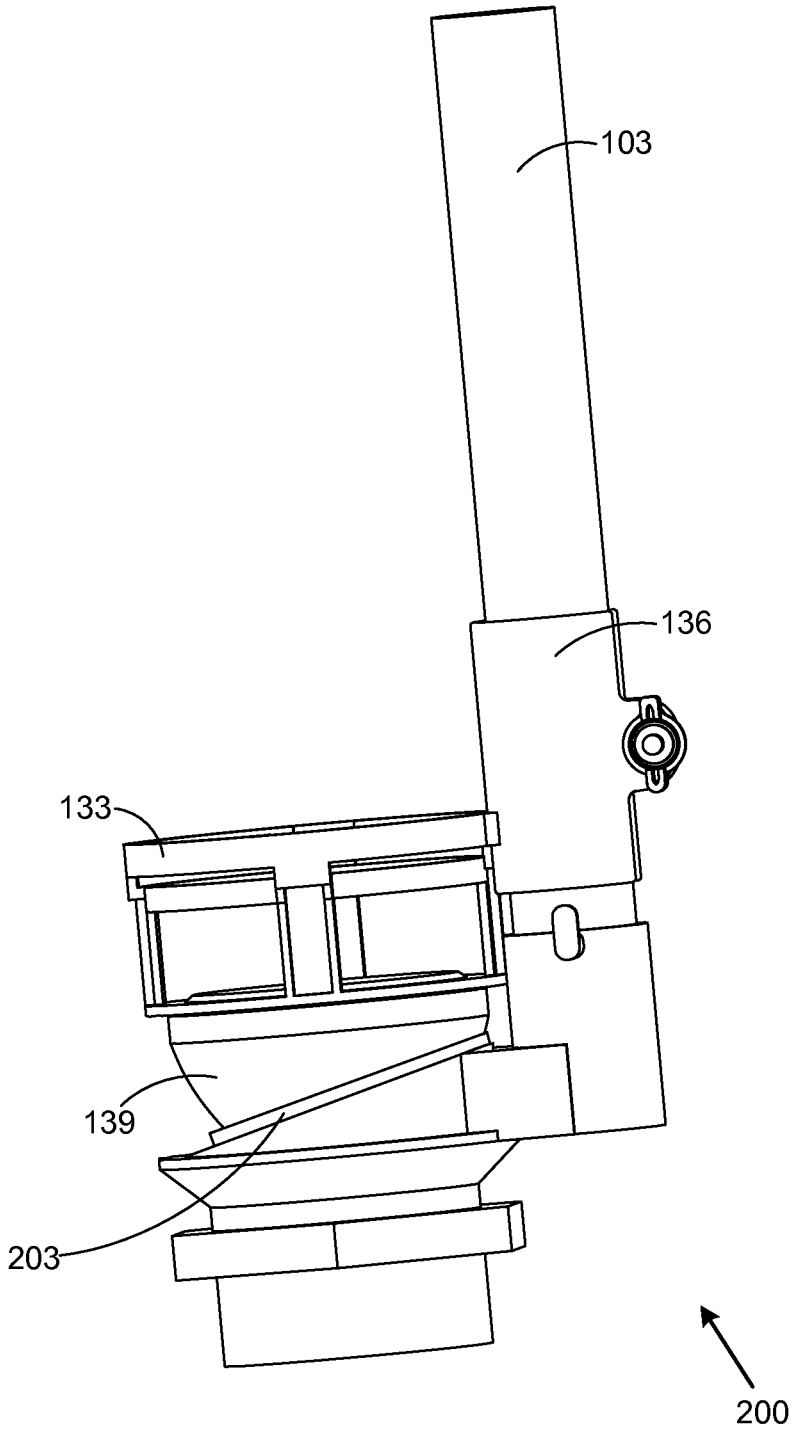
FIGS. 2A-2C are drawings that provide various views of another single flush toilet flush valve with a dual flush adaptor according to various embodiments.
Figure 2B:
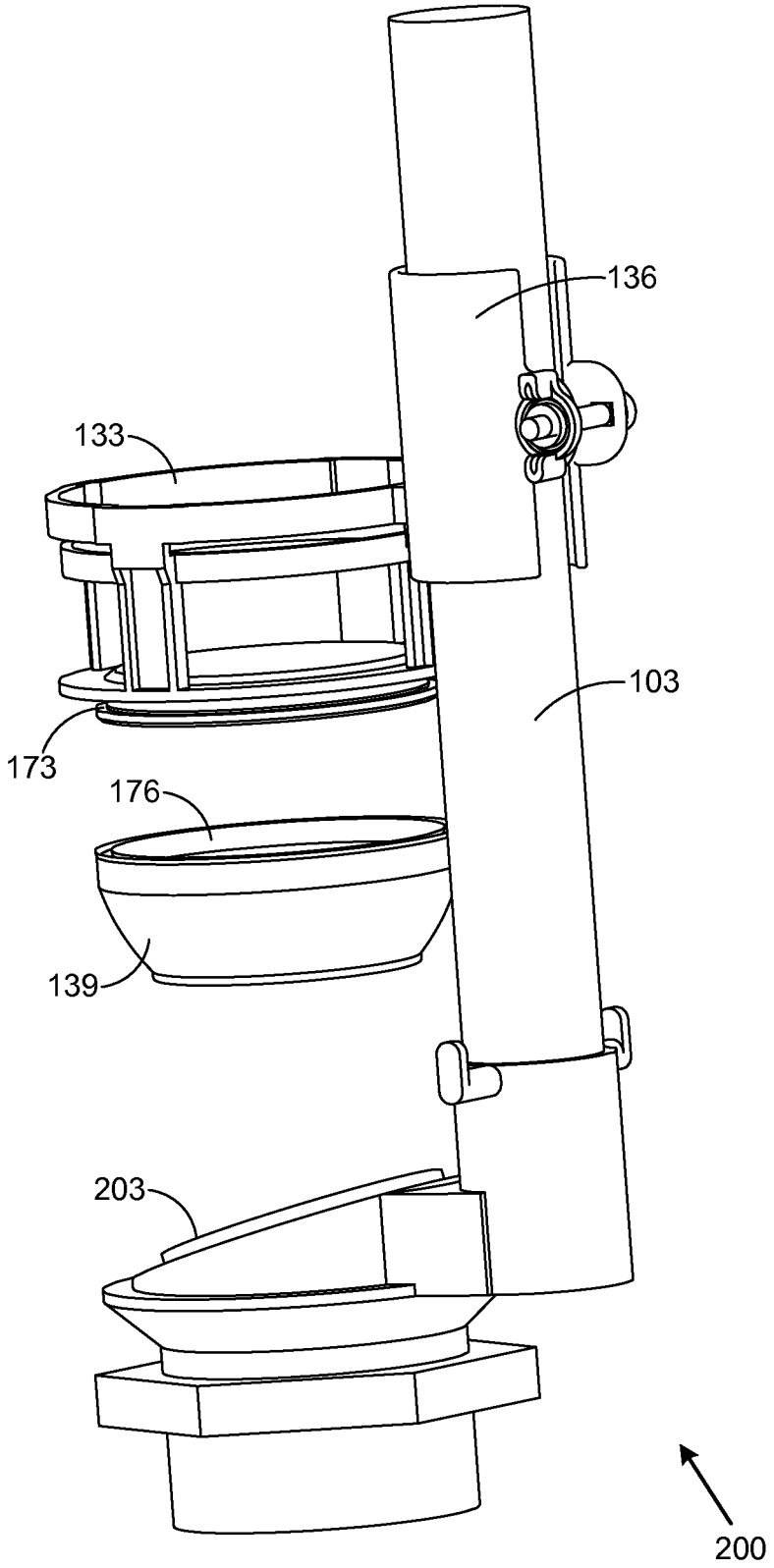
Figure 2C:
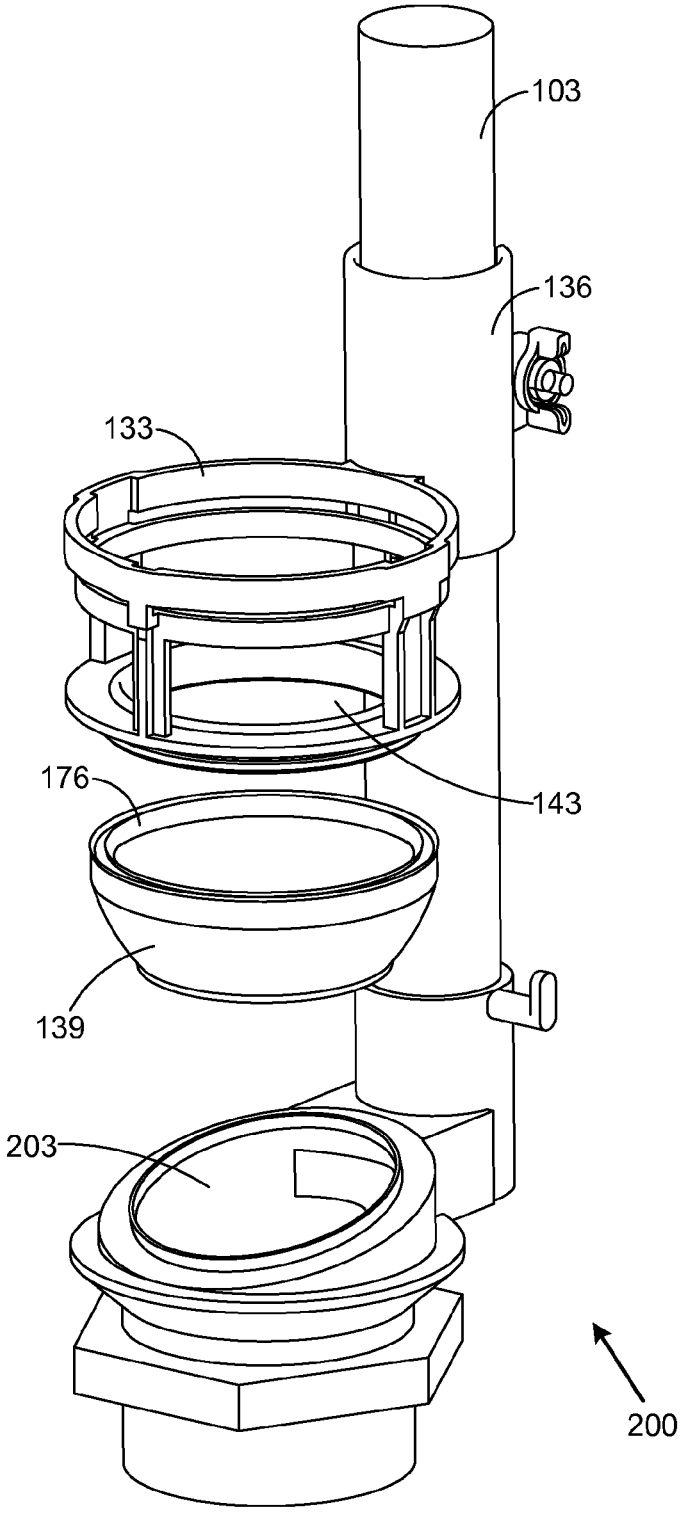

With reference next to FIGS. 2A-2C, shown is a flush valve 200 that includes an angled flush orifice 203. To this end, the flush valve 200 is much the same as the flush valve 100 except for the fact that the flush orifice 203 is angled to accommodate the type of flapper or sealing member used to contain the water in the toilet tank and operate a flush cycle as can be appreciated. The adapter 133 and the clamp 136 are unchanged. The gasket 139 may be shaped to conform with the orifice 203 to the extent that the orifice 203 is elliptical in nature relative to the gasket 139 due to the angling of the flush orifice 203.

With reference to FIGS. 3A-3E, shown is another arrangement for affixing a dual flush adapter 133 to the overflow tube 103. The adapter 133 includes at least one arm 303 that extends from the adapter 133. In the embodiment of FIGS. 3A-3E, two arms 303 extend from the upper rim 306 of the adapter 133. In other embodiments, the arm(s) 303 may extend from another portion of the adapter 133, e.g., down members 309.

A mounting bracket 313 is affixed to the down tube 103. In the embodiment of FIGS. 3A-3E, the mounting bracket 313 is clamped to the down tube 103 and secured in position by a bolt 316 using a nut or a threaded opening in the mounting bracket 313. In other embodiments, securing means such as, but not limited to, screws, tabs, ties, etc. may be used to secure the mounting bracket 313 in position on down tube 103.

Figure 3C:
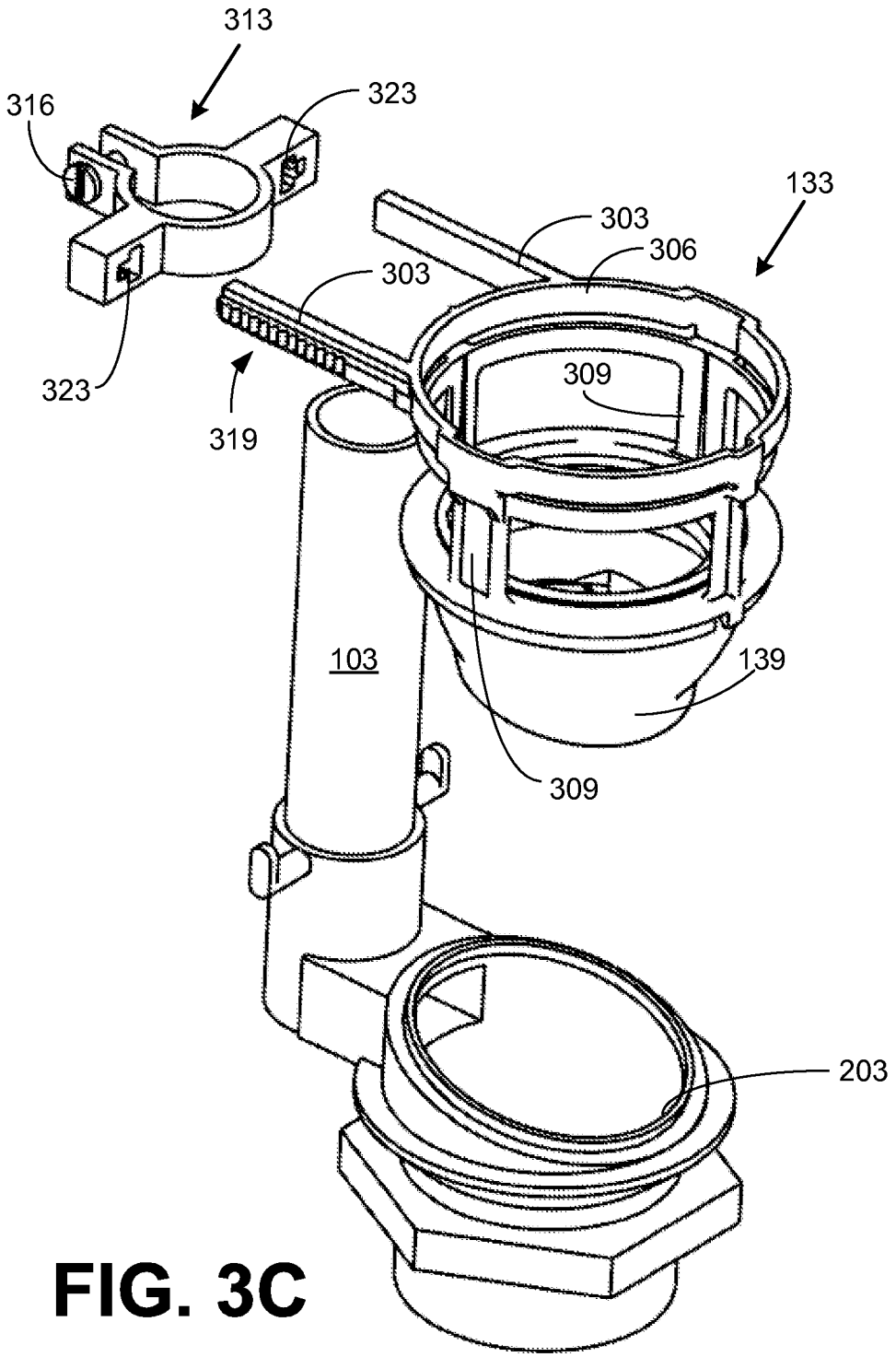
Figure 3E:
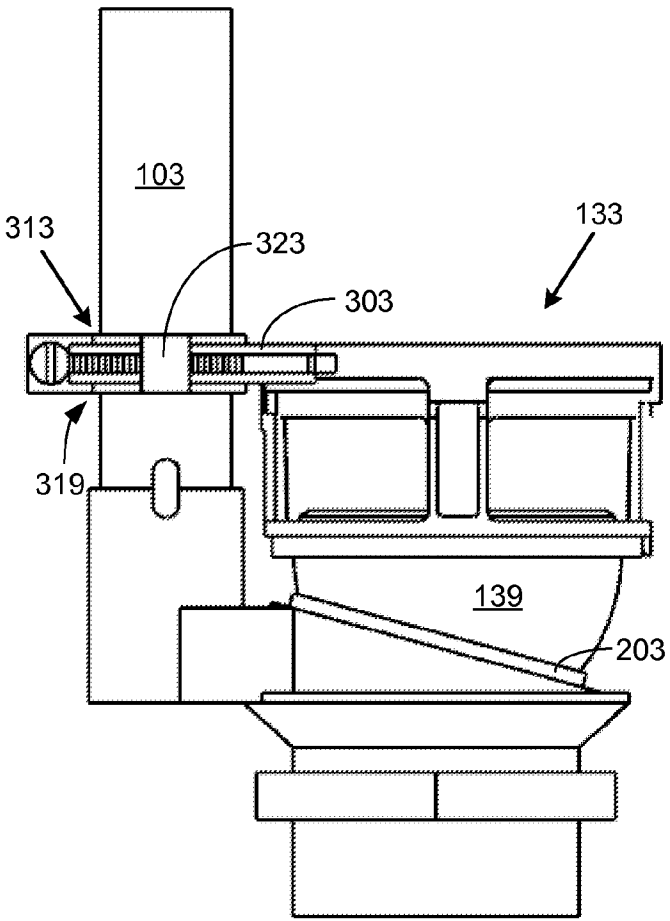
Figure 3D:
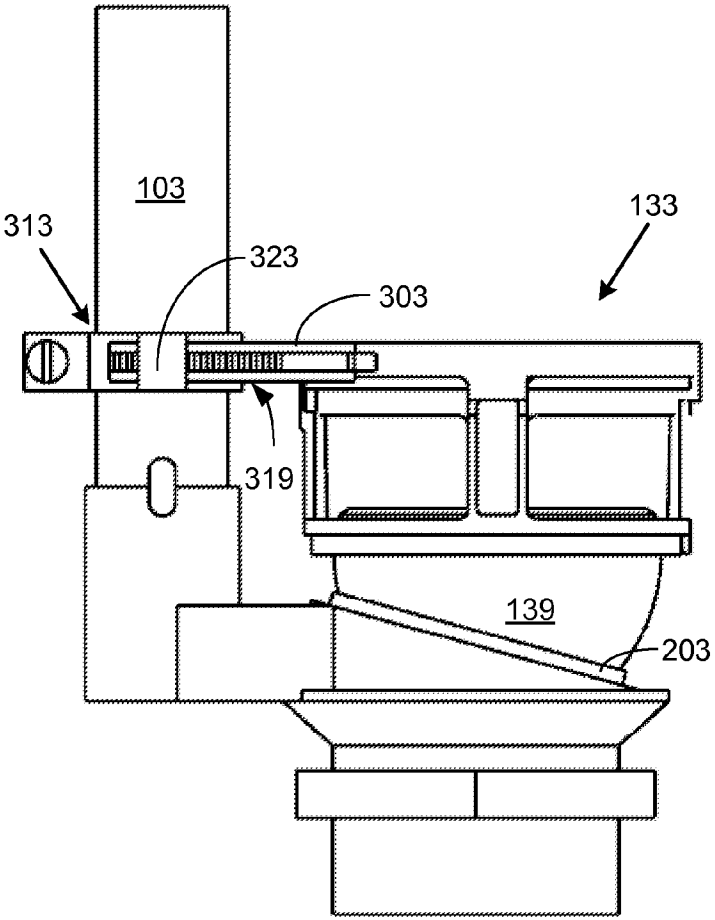

The arms 303 are configured to engage with the mounting bracket 313. In the embodiment of FIGS. 3A-3E, arm 303 includes a serrated edge 319 for positioning of gasket 139 within the flush orifice 203. The mounting bracket 313 includes a corresponding ratchet mechanism 323 that engages with the serrated edge 319 of the arm 303 to secure the adapter 133 and gasket 139 in position. FIGS. 3D-3E illustrate the variation in positioning of the adapter 133 and gasket 139 to provide for alignment of the gasket 139 with an orifice 203. Variations in the location of the orifice 203 with respect to the down tube 103 can be accounted for by movement of the arm(s) 303 within the ratchet mechanism(s) 323. In some embodiments, the ratchet mechanism 323 may allow for movement of the arm 303 in both directions. Alternatively, the ratchet mechanism may only allow the arm 303 to be adjusted in a single direction unless the ratchet mechanism 323 is disengaged from the serrated edge 319 of the arm 303.

In other embodiments, the mounting bracket 313 includes a securing mechanism in place of the ratchet mechanism 323 that engages with the arm 303 to secure the adapter 133 and gasket 139 in position. The securing mechanism may include an adjusting or set screw or other appropriate securing device that, when engaged with the arm 303, holds gasket 139 in alignment with orifice 203. Releasing the securing mechanism allows for adapter adjustment.

Figure 4A:
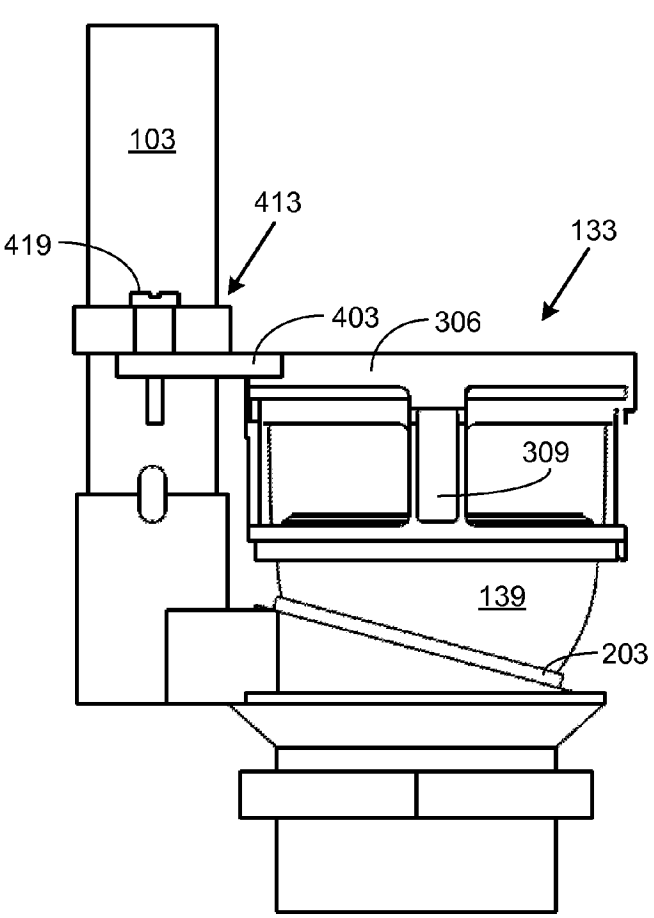
Figure 4A:
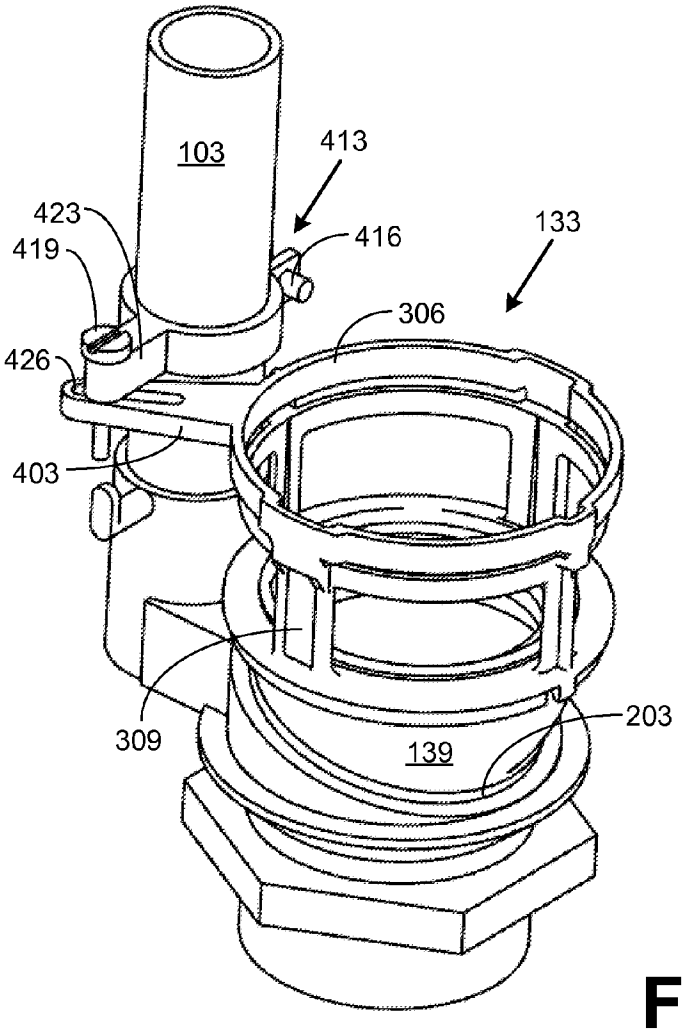
Figure 4B:
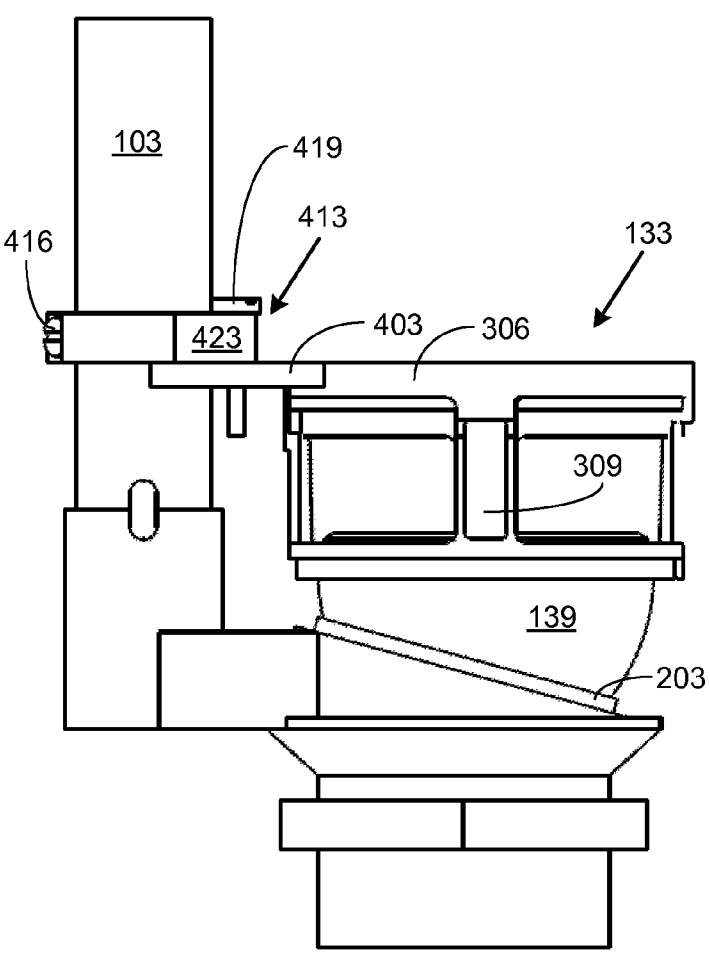
Figure 4B:
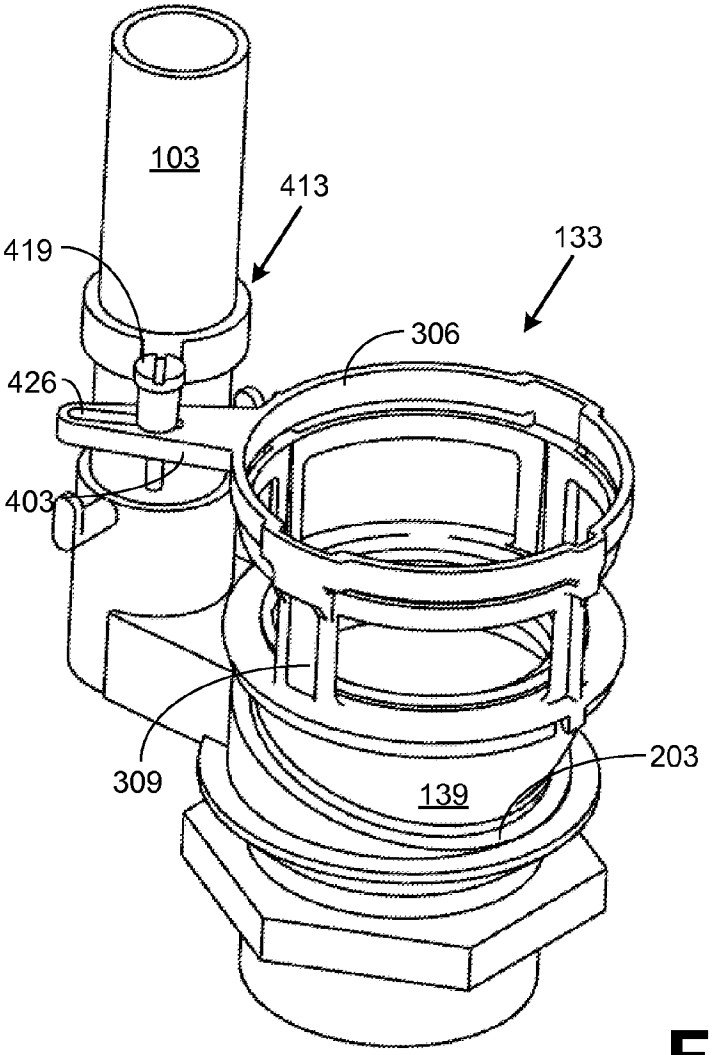

Referring next to FIGS. 4A-4B, shown is another arrangement for affixing a dual flush adapter 133 to the overflow tube 103. The adapter 133 includes an adjustment arm 403 that extends from the adapter 133. In the embodiment of FIGS. 4A-4B, the adjustment arm 403 extends from the upper rim 306 of the adapter 133. In other embodiments, the adjustment arm 403 may extend from another portion of the adapter 133, e.g., a down member 309.

A mounting bracket 413 is affixed to the down tube 103. In the embodiment of FIGS. 4A-4B, the mounting bracket 413 is clamped to the down tube 103 and secured in position by a bolt 416 using a nut or a threaded opening in the mounting bracket 413. In other embodiments, securing means such as, but not limited to, screws, tabs, ties, etc. may be used to secure the mounting bracket 413 in position on down tube 103.

The adjustment arm 403 is configured to be secured to the mounting bracket 413 using a bolt 419 and nut or other appropriate fastening means. Bolt 419 extends through an extension 423 of the mounting bracket 413 and a slot 426 of the adjustment arm 403. By rotating the mounting bracket 413 and adjusting the position of bolt 419 within slot 426, the position of the adapter 133 and gasket 139 may be adjusted to provide for alignment of the gasket 139 with an orifice 203.

FIGS. 4A-4B illustrate the variation in positioning of the adapter 133 and gasket 139 to provide for alignment of the gasket 139 with an orifice 203. In FIG. 4A, the mounting bracket 413 and adjustment arm 403 are secured in a first position to align gasket 139 with the orifice 203. In FIG. 4B, the orifice 203 is located further away from down tube 103. Accordingly, the mounting bracket 413 has been rotated on the down tube 103 and bolt 419 has been translated within the slot 426 to align gasket 139 with the orifice 203. The mounting bracket 413 and adjustment arm 403 are secured in this second position to maintain alignment with orifice 203.

Figure 5A:
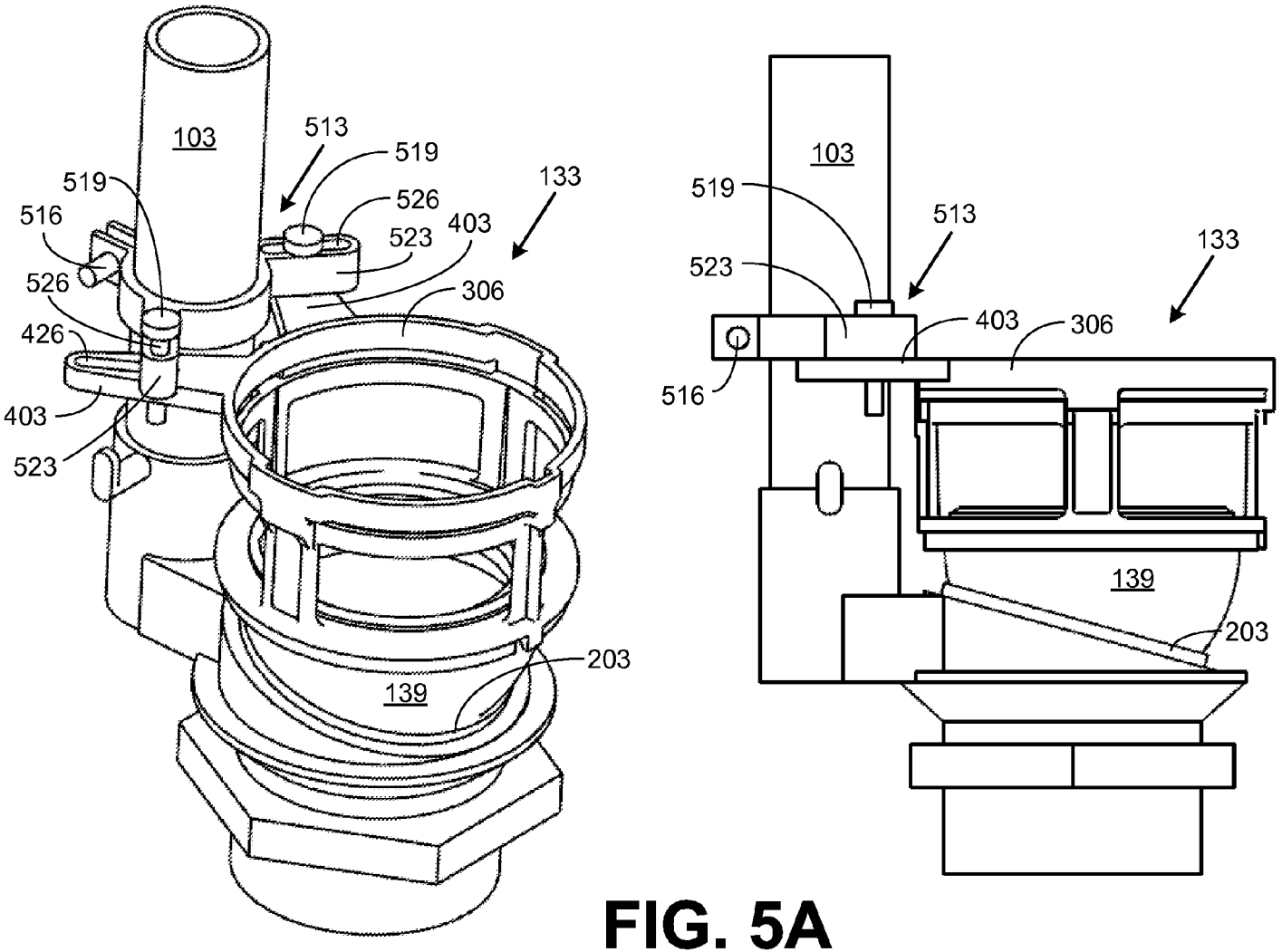
Figure 5B:
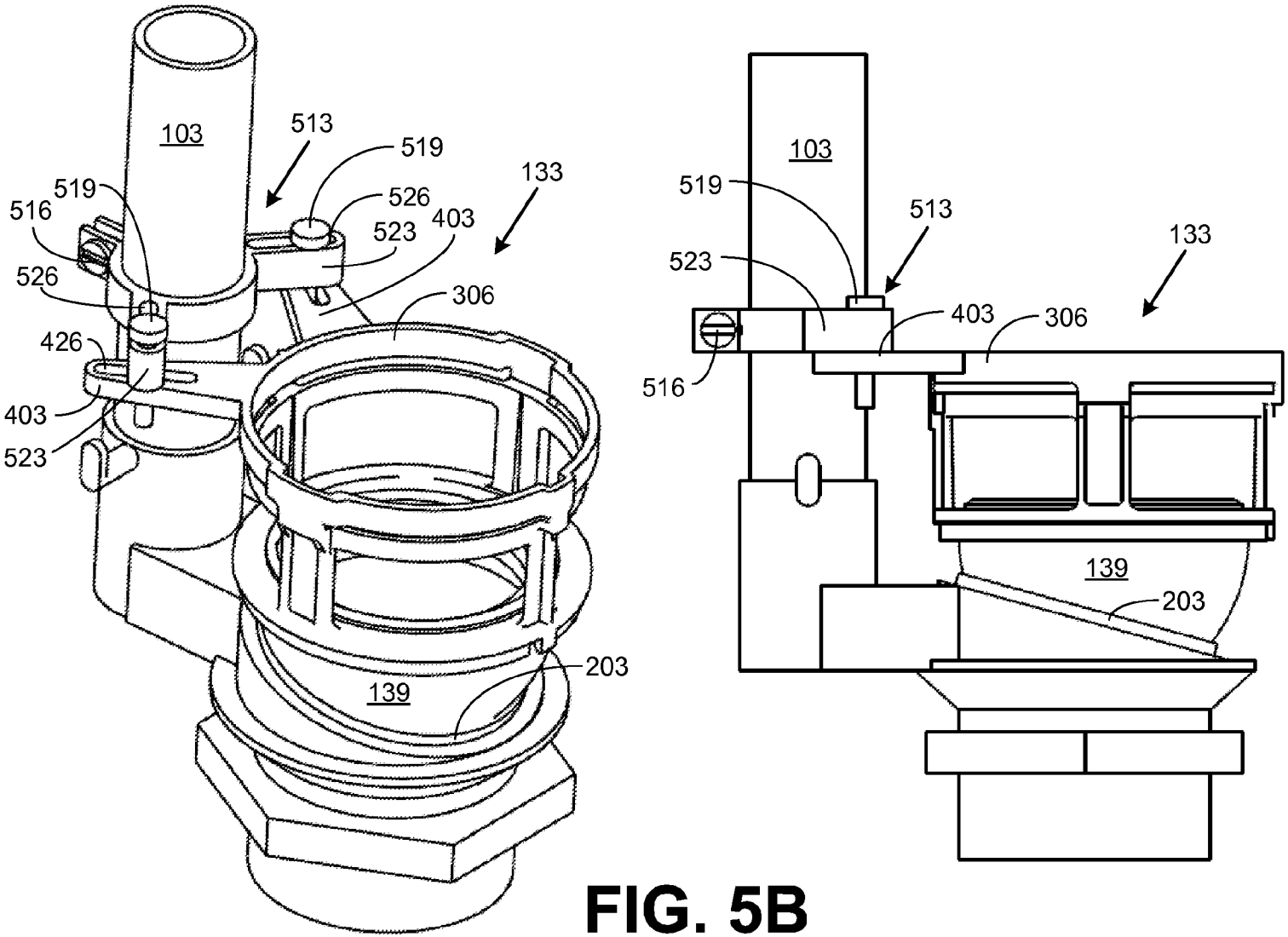

Referring now to FIGS. 5A-5B, shown is another arrangement for affixing a dual flush adapter 133 to the overflow tube 103. The adapter 133 includes two adjustment arms 403 that extend from the adapter 133. In the embodiment of FIGS. 5A-5B, the adjustment arms 403 extend from the upper rim 306 of the adapter 133.

A mounting bracket 513 is affixed to the down tube 103. In the embodiment of FIGS. 5A-5B, the mounting bracket 513 is clamped to the down tube 103 and secured in position by a bolt 516 using a nut or a threaded opening in the mounting bracket 513. In other embodiments, securing means such as, but not limited to, screws, tabs, ties, etc. may be used to secure the mounting bracket 513 in position on down tube 103.

The adjustment arms 403 are configured to be secured to the mounting bracket 513 using a bolt 519 and nut or other appropriate fastening means. Bolts 519 extend through a slot 526 in extensions 523 of the mounting bracket 513 and a slot 426 of the adjustment arms 403. Slots 426 in the adjustment arms 430 and slots 526 in the mounting bracket extensions 523 allow for repositioning of the adapter 133 and gasket 139 for alignment of the gasket 139 with an orifice 203 without rotating the mounting bracket 513.

FIGS. 5A and 5B illustrate the variation in positioning of the adapter 133 and gasket 139 to provide for alignment of the gasket 139 with an orifice 203. In FIG. 5A, the adjustment arms 403 are secured in a first position to align gasket 139 with the orifice 203. In FIG. 5B, the orifice 203 is located further away from down tube 103. Accordingly, the bolts 519 have been translated within slots 426 and slots 526 to align gasket 139 with the orifice 203. The adjustment arms 403 are secured in this second position to maintain alignment with orifice 203.

Referring to FIGS. 6A-6D, shown is another arrangement for affixing a dual flush adapter 133 to the overflow tube 103. In the embodiments of FIGS. 6A-6D, the adapter 133 includes a mounting flange 603 affixed to the upper rim 306 of the adapter 133. In other embodiments, the mounting flange 603 may be affixed to another portion of the adapter 133, e.g., a down member 309. A mounting ring 606 extends around the down tube 103 and is fastened to the mounting flange 603 to secure the adapter 133 and gasket 139 in position. With openings 609 aligned, the mounting ring 606 may be secured to the mounting flange 603 by bolts and nuts, screws, zip ties, or other suitable fasteners.

Figure 6A:
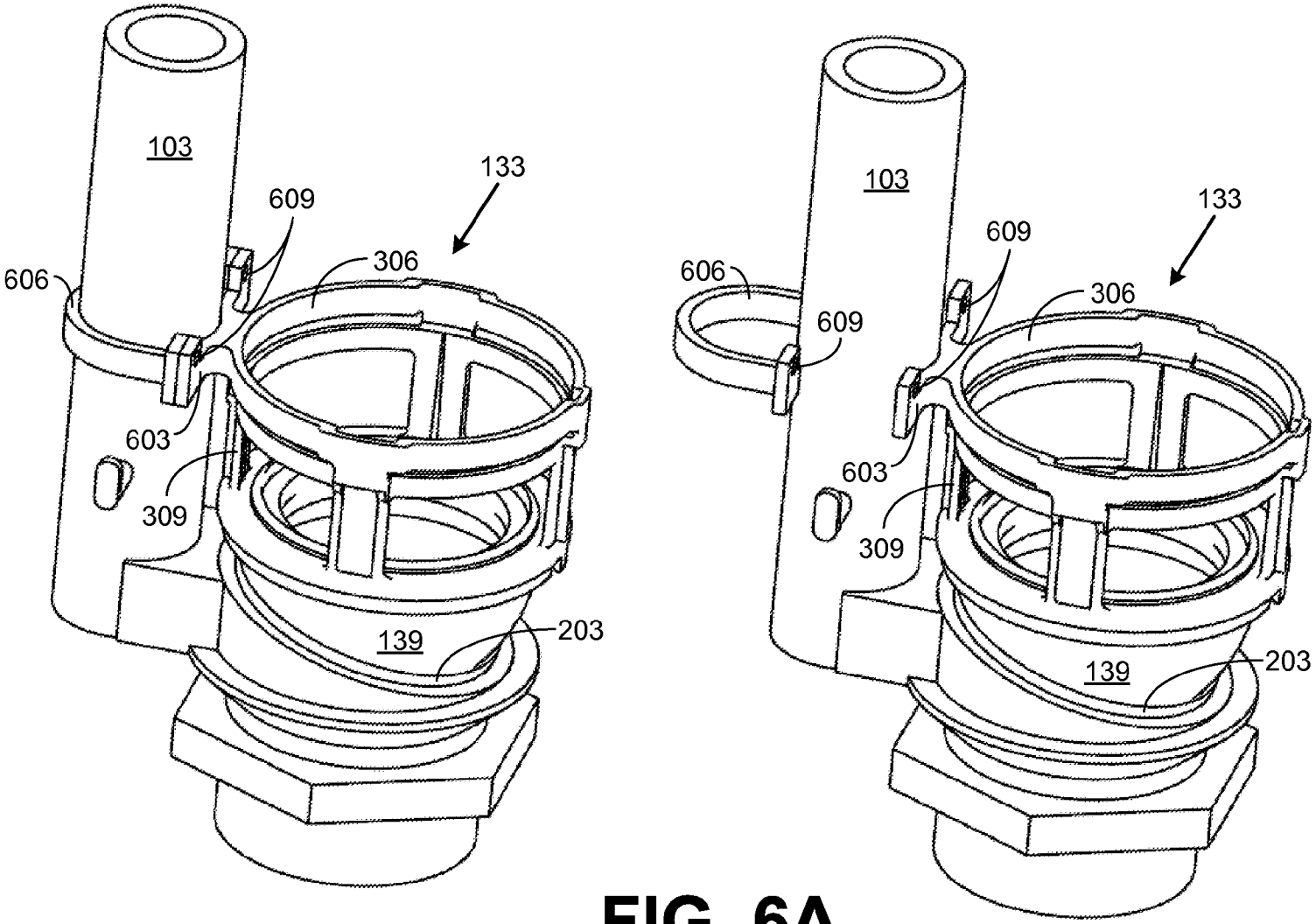
Figure 6B:
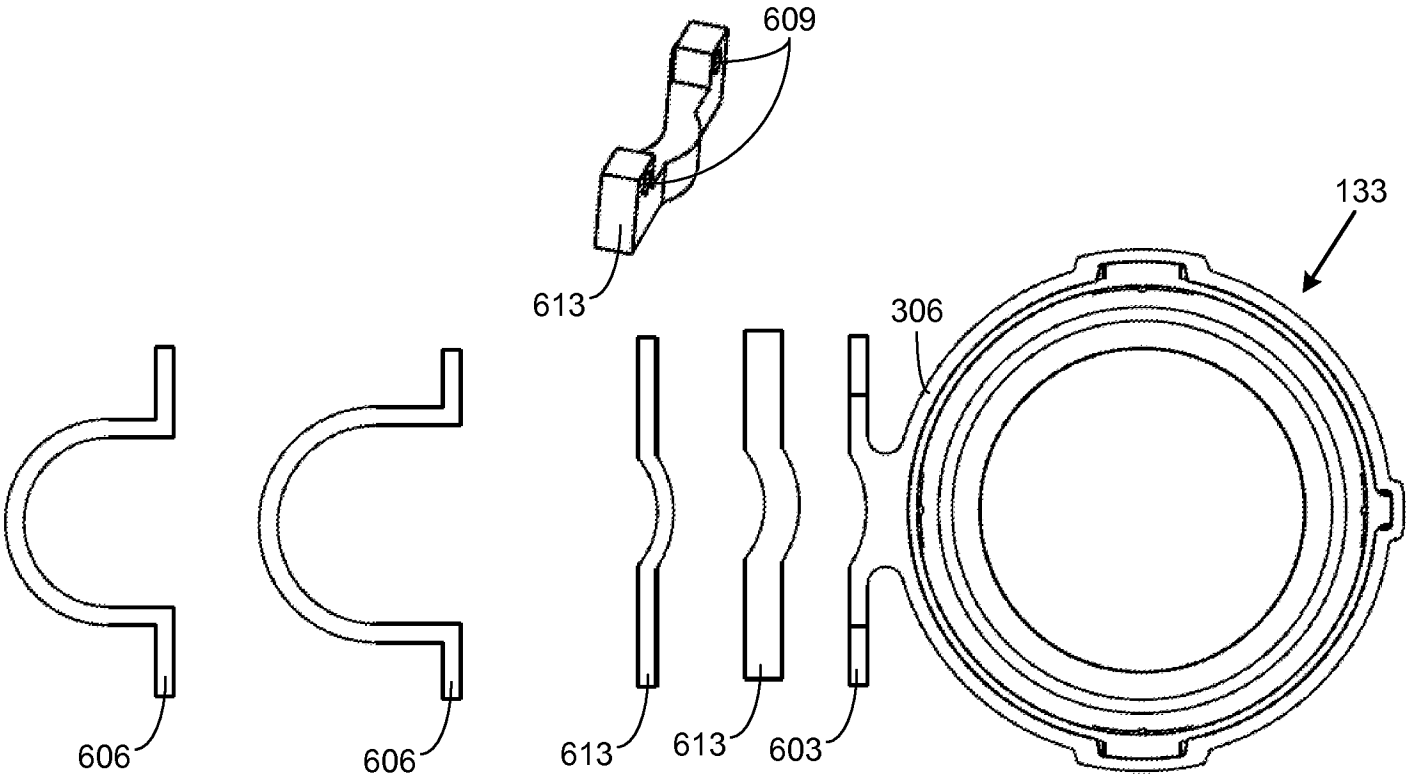
Figure 6D:
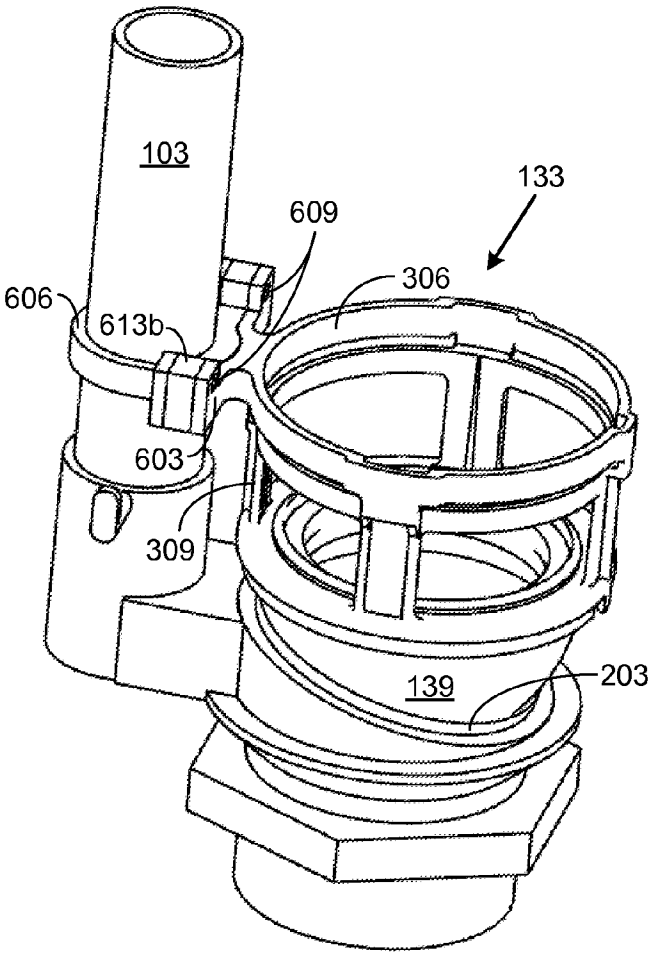
Figure 6C:
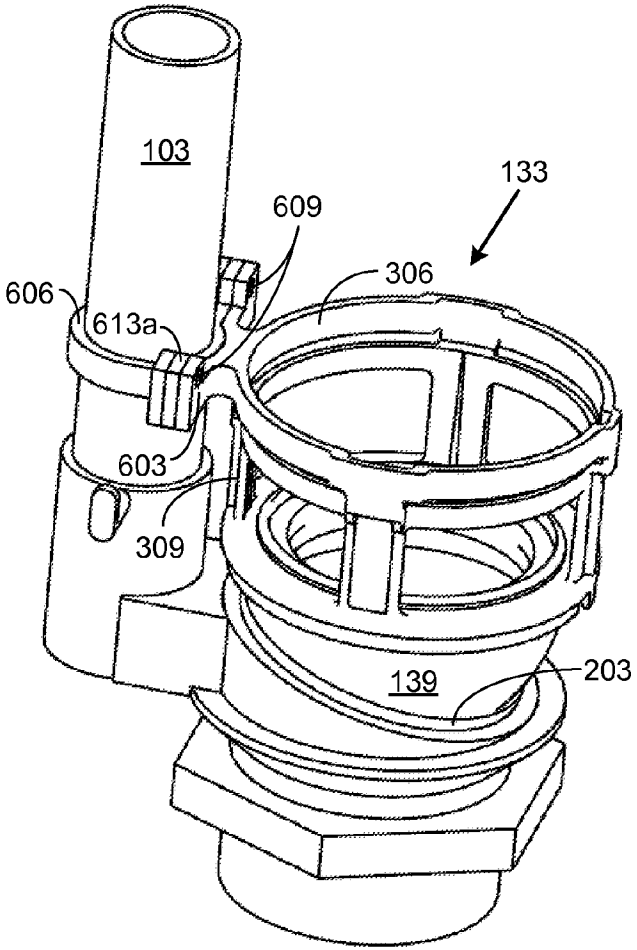

The position of the adapter 133 and gasket 139 may be adjusted using shims 613 and/or rings 606 of various sizes as illustrated in FIG. 6B. The shims 613 include openings 609 that are aligned with the openings 609 of the mounting flange 603 and mounting ring 606 when secured in position on the down tube 103. FIGS. 6C and 6D illustrate the variation in positioning of the adapter 133 and gasket 139 to provide for alignment of the gasket 139 with an orifice 203. In FIG. 6C, a first shim 613*a* is used to align gasket 139 with the orifice 203. In FIG. 6D, the orifice 203 is located further away from down tube 103. Accordingly, a thicker shim 613*b* is utilized to align gasket 139 with the orifice 203. With openings 609 aligned, the mounting ring 606 and shim 613 may be secured to the mounting flange 603 by bolts and nuts, screws, zip ties, or other suitable fasteners.

Figure 7A:
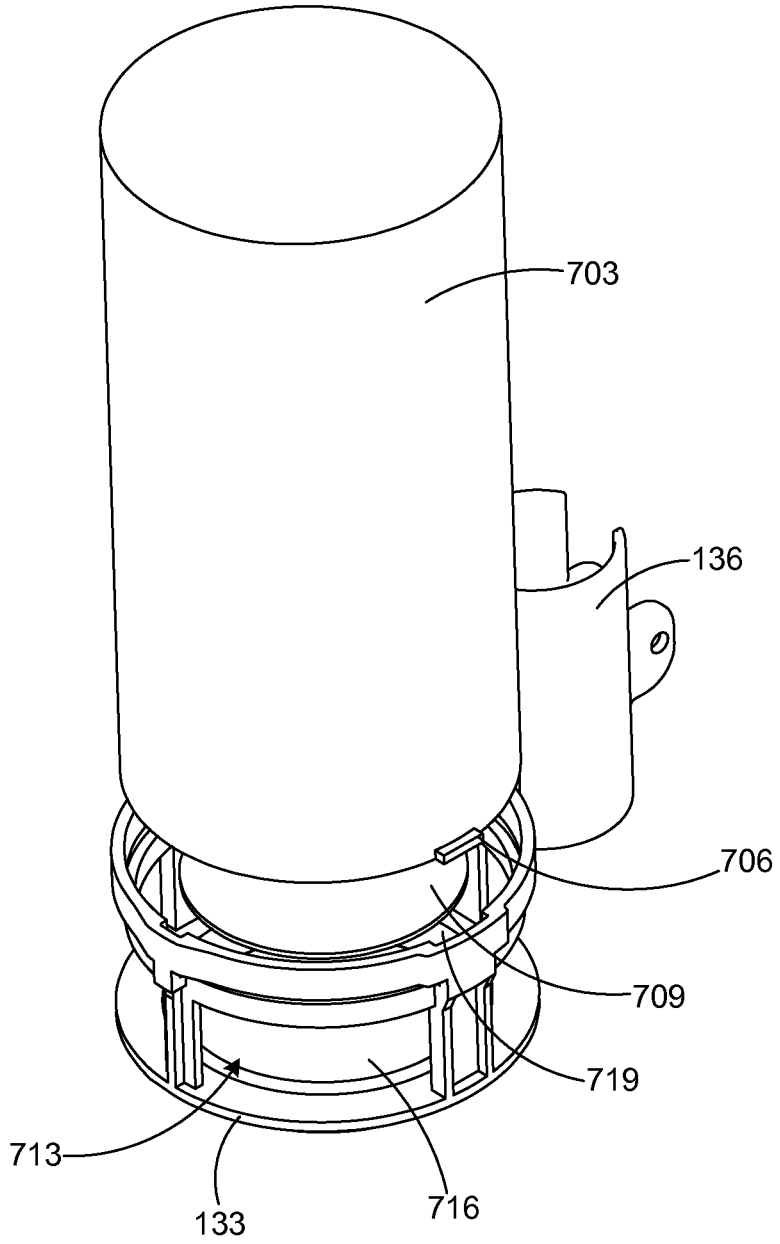
FIGS. 7A and 7B are drawings that illustrate the coupling of a dual flush canister to the dual flush adaptor of FIGS. 3A-6D according to various embodiments.
Figure 7B:
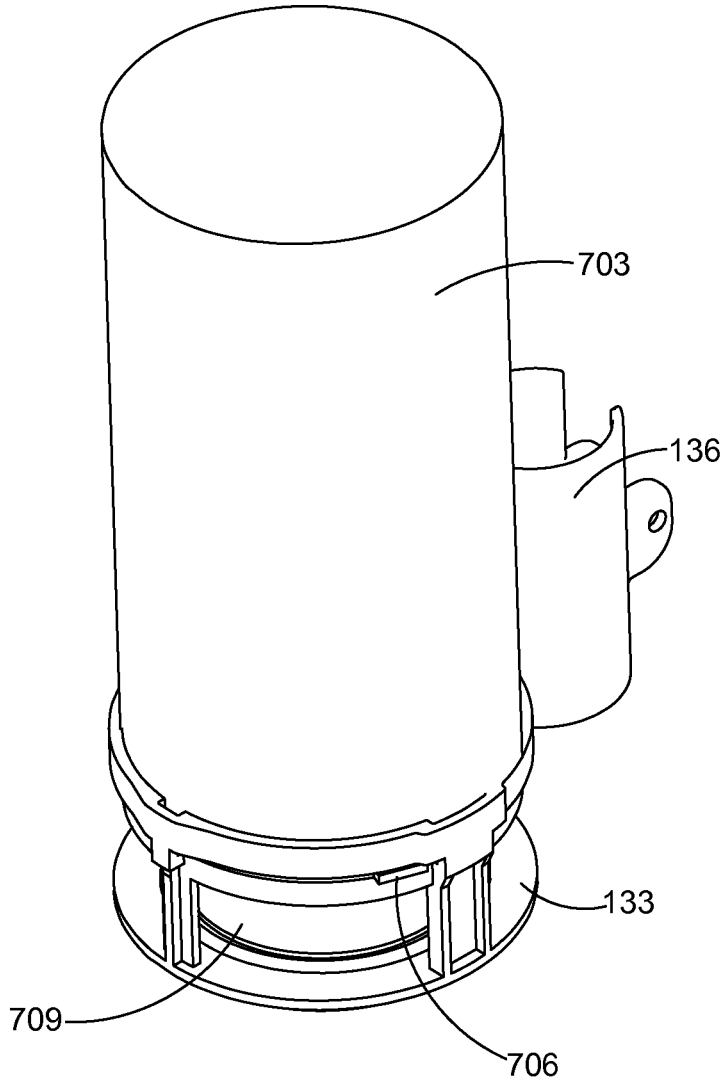

With reference to FIGS. 7A and 7B, shown is how the adapter 133 mates with a dual flush canister 703 according to various embodiments. The dual flush canister 703 includes mating ears 706 that slide into the grooves 719 and can be rotated within an annular groove. Attached to the dual flush canister 703 is a sealing member 709 that closes the flush orifice 716 of the adapter 133 when the dual flush canister 703 is idle. The sides of the adapter 133 feature water flow openings 713 that allow water to enter into the adapter 133 and flow through the flush orifice 143 when a flush is implemented. A flush is implemented when the mechanisms in the dual flush canister 703 lift the sealing member 709 to allow water to flow into the flush orifice 716 of the adapter and through the flush valve to a toilet bowl. In an alternative embodiment, the adapter 133 may actually be an integrally molded portion of the dual flush canister 703. Furthermore, the dual flush canister may be similar to the dual flush canister manufactured by OEM toilet manufacturers and suppliers like CRN, LAB, VIB, R&T, WDI and Nison.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:

an adapter configured to attach to a flush mechanism configured to provide for a predefined flush capability in a toilet, the adapter comprising a circular attachment ring and a mounting flange located at an attachment point on a circumference of the circular attachment ring, the mounting flange substantially perpendicular to a diameter of the circular attachment ring that extends from the attachment point and passes through a center of the circular attachment ring; the mounting flange comprising a side opposite the adapter including first and second linear end sections that are substantially aligned, and have a thickness, and a central concave section configured to vertically align with a down tube, where the central concave section curves inward from the side opposite the adapter to a depth that is substantially the thickness of the first and second linear end sections;

a gasket attached to the adapter, the gasket forming a seal between the flush mechanism and a flush orifice of a flush valve, where the flush valve is configured to seat a sealing member; and means for securing the gasket in position with respect to the flush orifice of the flush valve comprising a mounting ring configured to be secured around the down tube of the flush valve when fastened to the mounting flange, where the adapter is radially offset from the down tube of the flush valve by a shim positioned between the mounting flange and the down tube, and substantially tangent to a circumference of the down tube, to align the gasket with the flush orifice.

2. The apparatus of claim 1, wherein the means for securing the gasket in position comprises a plurality of shims positioned between the mounting flange and the down tube for adjustably offsetting the adapter from the down tube.

3. The apparatus of claim 1, wherein the shim is secured between the mounting flange and the mounting ring to offset the adapter from the down tube for alignment of the gasket with the flush orifice.

4. The apparatus of claim 3, further comprising a plurality of shims configured to be secured between the mounting flange and the mounting ring to offset the adapter from the down tube.

5. The apparatus of claim 1, further comprising the flush mechanism coupled to the circular attachment ring.

6. The apparatus of claim 5, wherein the flush mechanism is a dual flush canister.

7. The apparatus of claim 3, wherein the shim comprises a central concave section that contacts and vertically aligns with a portion of the down tube.

8. The apparatus of claim 3, comprising a plurality of shims secured between the mounting flange and the mounting ring to align the gasket with the flush orifice.

9. The apparatus of claim 1, wherein the shim comprises a first side and a second side opposite the first side, the first side including a central convex section configured to align with the central concave section of the mounting flange and the second side including a central concave section configured to vertically align with the down tube.

10. The apparatus of claim 1, wherein the side opposite the circular attachment ring of the adapter is substantially tangent to the circumference of the down tube.

11. An apparatus, comprising:

an adapter configured to attach to a flush mechanism configured to provide for a predefined flush capability in a toilet, the adapter including an integral mounting flange that is substantially tangent to a circumference of the adapter, the mounting flange comprising a central concave section between first and second linear end sections that are substantially aligned, and have a thickness, where the central concave section curves inward from a side opposite the adapter to a depth that is substantially the thickness of the first and second linear end sections;

a gasket attached to the adapter, the gasket forming a seal between the flush mechanism and a flush orifice of a flush valve, where the flush valve is configured to seat a sealing member;

a mounting ring configured to be secured around a down tube of the flush valve when fastened to the mounting flange, the mounting ring fastened to the mounting flange by at least one fastener; and a shim configured to be secured between the mounting flange and the mounting ring with a portion of the shim positioned between the mounting flange and the down tube, and substantially tangent to a circumference of the down tube, by the at least one fastener to radially offset the adapter from the down tube to align the gasket with the flush orifice, the shim comprising a side adjacent to the mounting flange including a central convex section configured to vertically align with the central concave section of the mounting flange.

12. The apparatus of claim 11, wherein the shim comprises a side opposite the mounting flange including a central concave section configured to vertically align with the down tube, where the central concave section is between first and second linear end sections of the shim, which are substantially aligned.

13. The apparatus of claim 12, wherein at least a portion of the central concave section is in contact with the down tube.

14. The apparatus of claim 11, comprising a plurality of shims secured between the mounting flange and the mounting ring by the at least one fastener to offset the adapter to align the gasket with the flush orifice.

15. The apparatus of claim 11, wherein the mounting ring comprises a semicircular section configured to engage the down tube opposite the mounting flange and two linear sections extending tangentially from ends of the semicircular section to fastening tabs.

16. The apparatus of claim 11, further comprising the flush mechanism.

17. The apparatus of claim 16, wherein the flush mechanism is a dual flush canister.

* * * * *